United States Patent [19]

Uesugi

[11] 4,172,695

[45] Oct. 30, 1979

[54] PUMP UNIT

[75] Inventor: Hisao Uesugi, Fujisawa, Japan

[73] Assignee: Ebara Corporation, Tokyo

[21] Appl. No.: 818,840

[22] Filed: Jul. 25, 1977

[30] Foreign Application Priority Data

| | | | |
|---|---|---|---|
| Jul. 30, 1976 | [JP] | Japan | 51/100903[U] |
| Sep. 3, 1976 | [JP] | Japan | 51/117774[U] |
| Sep. 3, 1976 | [JP] | Japan | 51/117775[U] |
| Sep. 3, 1976 | [JP] | Japan | 51/117776[U] |

[51] Int. Cl.[2] ..... F04B 17/00

[52] U.S. Cl. ..... 417/424; 415/127

[58] Field of Search ..... 415/127, 219 C, DIG. 5, 415/126, 127; 417/424

[56] References Cited

U.S. PATENT DOCUMENTS

| | | | |
|---|---|---|---|
| 1,558,055 | 10/1925 | Smith | 415/127 |
| 2,738,787 | 3/1956 | Jacuzzi et al. | 417/424 |
| 2,952,213 | 9/1960 | Goettl | 417/424 |
| 3,306,527 | 2/1967 | Cook | 415/127 |
| 3,846,848 | 11/1974 | McNair | 415/127 |

*Primary Examiner*—Carlton R. Croyle
*Assistant Examiner*—Edward Look
*Attorney, Agent, or Firm*—Oblon, Fisher, Spivak, McClelland & Maier

[57] ABSTRACT

A pump unit is disclosed which is used in feeding liquid in pipe line. The unit comprises a motor section and a pump section axially coupled with each other. The pump section includes a volute casing in which an impeller is rotatably mounted on an extended shaft of the motor and a cover plate having suctioning opening is attached to the volute casing in such a manner that it is radially adjustable to the casing at the time of installation, whereby the alignment of the suctioning opening with the impeller is made easy. The construction of the casings and parts related thereto are designed so that the elements involved are possible to be produced out of sheet metal stock. Further, the air ventilation system of the motor section is designed so as to prevent the entrance of liquid, rain or water droplets into the inside of the motor.

16 Claims, 5 Drawing Figures

PUMP UNIT

FIELD OF INVENTION

This invention relates to a pump and more particularly to an improved pump construction comprising a motor section and a pump section for use in feeding liquid in a pipe or plumbing line.

BACKGROUND OF INVENTION

It has been customary to employ a pump unit unitarily combining a pump section and a motor section in feeding liquid in piping lines. In such a pump unit, the pump section and the motor section are generally installed in a casing as a unit and, thus, the rotatable shaft thereof is not required to project through its casing. However, in assembly of such a unit it has been a problem to establish proper alignment of the impeller of the pump with respect to the pump casing thereby consuming many manhours. Also, to achieve the required alignment, the elements or components had to be made to strict tolerances.

Also, in order to prevent leakage of liquid from the pump section into the motor section, a mechanical seal has usually been employed where the rotational shaft extends through a pump casing. However, if failure occurs in the mechanical seal, liquid will leak from the seal and enter the motor section thereby creating the possibility of wetting the motor coil. To protect the motor section from such possibility, a drain ring has been installed on the shaft; however, the drain ring has not been satisfactory since it does not completely prevent the motor section from getting wet.

Also, the temperature of the motor and the motor unit is usually raised during use and, thus, air ventilation is essential in this type of pump unit. However, if efficiency of the ventilation is improved, it increases the chance that rain or water may easily get inside the motor section and cause malfunction of the motor. Further, a pump casing having an inlet port and an outlet port and a volute casing to be disposed within the pump casing have been unitarily produced by casting process; however, the casting process has been relatively difficult due to the complicated structure of the casings. Also, in order to effect complete sealing of the casing, it has been necessary to dispose a seal member on top of the casing between the pump casing and the upper wall covering the casing.

Accordingly, it has been desired to obviate the drawbacks above in the pump unit of the prior art.

SUMMARY OF INVENTION

It is an object of this invention to provide a pump unit in which it is easy to align the impeller with the pump casing, particularly with the volute chamber within the pump casing.

It is also another object of this invention to provide a pump unit wherein a safety measure is provided to prevent liquid from entering the motor section even if the mechanical seal disposed between the motor section and the pump section fails.

It is a further object of this invention to provide a pump unit wherein an effective ventilating system is included so as to prevent rain or water droplets from entering into the motor section while maintaining the possibility of enough cooling by the ventilating system.

A further object of this invention is to provide a pump unit wherein elements constituting a pump casing and a volute casing are readily formed from sheet metal stock by using a conventional press or presses.

In accordance with this invention, an improved pump unit is provided wherein installation of a cover plate having a suctioning opening therein and adaptable for covering a volute chamber of the pump section is devised so as to be radially adjustable with respect to the axis of the impeller whereby trouble involved in aligning the shaft or impeller of the pump with the suctioning opening is obviated. Also most of the elements constituting the casings of the pump section are configured so they can be produced from sheet metal stock by using conventional pressing technique.

Further, the safety provision is considered to easily discharge liquid and/or rain and water droplets out of the motor section which otherwise may enter the motor and damage the electrical components.

Further advantages of this invention will be made clear by the detailed description of the embodiments which follows the brief description of the drawings noted below.

BRIEF DESCRIPTION OF DRAWINGS

In the detailed description of the preferred embodiments of the invention presented below, reference is made to the accompanying drawings wherein the same reference indicates the same element.

DETAILED DESCRIPTION OF PREFERRED EMBODIMENTS

Figure 1:
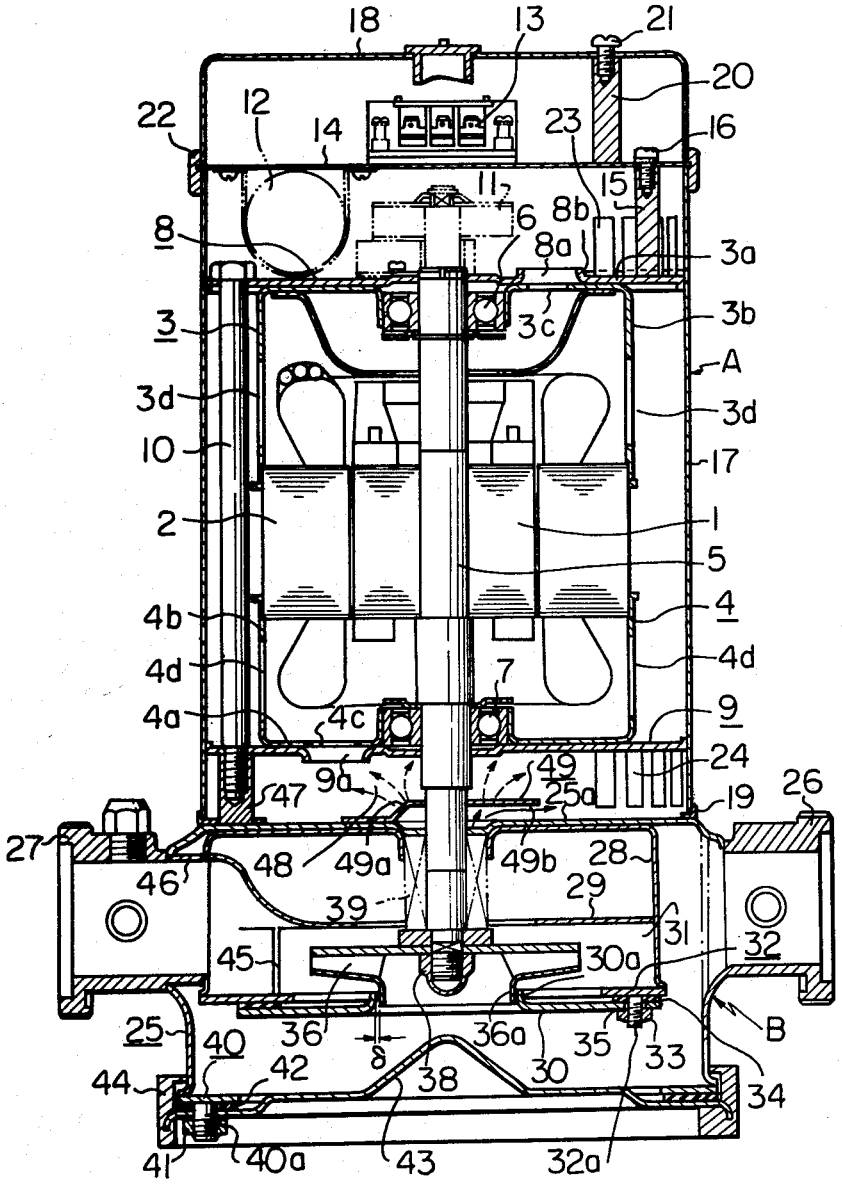
FIG. 1 is a cross-sectional view of one embodiment of this invention.

Referring to FIG. 1, there is illustrated a cross-section of a preferred embodiment of this invention which comprises a motor section "A" and a pump section "B". The motor section "A" comprises an electric motor having a rotor 1 and a stator 2, an upper-inner casing 3 and a lower inner casing 4, the motor being supported by the inner casings 3 and 4. A shaft 5 of the motor extends through the rotor 1 and is rotatably supported by bearings 6 and 7 which are secured to the upper and lower casings 3 and 4, respectively. In the drawings, the bearings 6 and 7 are illustrated as ball-bearings; however, another type bearing such as a plain metal bearing may be used.

In order to facilitate assembly of the sections "A" and "B", there are provided an upper plate 8 on the top of the upper inner casing 3 and a lower plate 9 beneath the lower inner casing 4. The motor together with the upper and lower inner casings 3, 4 and the upper and lower plates 8 and 9 are unitarily joined with the pump section "B" by screwing bolts 10 into studs 47 of the section "B", the bolts 10 longitudinally extending through the plates 8 and 9 and the threaded ends thereof are received by the female threads of the studs 47, respectively.

In the respective horizontal walls **3*a* and 4*a* and the vertical walls 3*b* and 4*b* of the casings 3 and 4, there are provided a plurality of vent holes 3*c*, 3*d*, 4*c* and 4*d*, respectively. In the plates 8 and 9, there are provided vent holes 8***a* and 9*a*, in the places corresponding to the positions of the vent holes 3*c* and 4*c*. At the top of the shaft 5, a governor switch 11 is mounted. Other electrical parts such as a capacitor 12 and electric terminals 13 for power source are secured to a plate member 14 which is coupled with the upper plate 8 by means of studs 15 and screws 16, each of the studs 15 being provided with female thread and mounted on the upper plate 8 as illustrated and the screws 16 being driven into the female threads so as to fasten the plate member 14 to the studs 15. The motor and its associated elements referred to above are further encased within an outer casing 17 and a top cover 18 for the outer casing. The aforementioned tightening operation of screws 16 also couples the outer casing 17 with the pump section "B" through a seal 19. The cover 18 is coupled to the plate member 14 by driving screws 21 into the female threads of studs 20 secured to the plate member 14 thereby being also unitarily coupled with the outer casing 17. At the outer portion connecting the cover 18 to the casing 17, there is disposed a sealing member 22.

In order to cool the motor and bearings 6 and 7 during operation, an air ventilation system is devised. To such end, a plurality of vent holes or slots 23 are formed in the area of the outer casing 17 corresponding to the space between the plate 8 and the member 14 and a plurality of vent holes or slots 24 are also formed in the area of the outer casing 17 corresponding to the space between the lower plate 9 and the pump section "B" so that several cooling air flow passages are established such as from the vent holes 23 through the vent holes 8*a*, 3*c*, the gap between the rotor 1 and the stator 2, vent holes 4*c*, 9*a* and towards the vent holes 24 or from the vent holes 23 through the vent holes 8*a*, 3*c*, the vent holes 3*d*, the gap between the stator 2 and the outer casing 17, the vent holes 4*d*, 4*c* and 9*a* and thence towards the vent holes 24.

Also, means are provided for preventing water such as rain or droplets from entering the inside of the motor section "A". As indicated by reference 8*b*, an upwardly directed flange is formed surrounding vent hole 8. Further the lower end of at least one or each of the slots 23 is devised so that it is on the same level as or somewhat lower than the upper surface of the plate 8. Therefore, water droplets entering the space between the plate member 14 and the plate 8 through the slots 23 are prevented from entering the portion through the holes 8*a* and 3*c* by the flange 8*b* and are discharged outwardly through the slots 23.

Although the terms "holes" and "slots" were employed, the shape thereof is not limited to the particular shapes illustrated and any shape may be selected so as to pass air therethrough.

Now turning to the pump section "B", its sectional illustration appears in the lower part of FIG. 1. An outer pump casing 25 encases the pump elements concerned which will be explained hereinafter. To this casing 25, an intake port element 26 and a discharge or outlet port element 27 are secured by any suitable means, e.g. by welding. Within the casing 25, there is provide a pan type volute casing 28 in which a plate or separator 29 is mounted so as to form a volute chamber 31 below the separator 29 together with a cover plate 30 to be placed to cover the opening of the volute casing 28.

An annular member 32 is attached to the lower periphery of the volute casing 28 by any suitable means such as welding and a plurality of stud bolts 32*a* are provided on the member 32 to secure the cover 30 thereon with nuts 33. Between the member 32 and the cover 30, an annular gasket or packing 34 is preferably disposed. The cover 30 is provided with a center hole through which liquid is sucked into the volute chamber 31 and perforations 34 at the circumferential periphery thereof through which the stud bolts 32*a* project to receive the nuts 33. The size or diameter of the respective perforations 34 is relatively large compared to the diameter of the respective bolts 32*a* so adjustment of the plate 30 in the radial direction is made possible in assembly.

Within the volute chamber, an impeller 36 is mounted at the lower end of the shaft 5 and tightly fastened thereto with a locking nut 38 so as to rotate unitarily with the shaft 5. The aforementioned cover plate 30 is, in fact, assembled to the volute casing 28 after the installation of the impeller 36. As already explained above, the plate 30 is adjustable in the radial direction thereof, the relative position or proper gap "δ" between the periphery 36*a* of the impeller and the central opening wall 30*a* of the cover plate is optionally and easily adjusted at installation. Therefore, aligning operation of the pump impeller relative to the suctioning opening of the volute chamber is made quite easy thereby saving the many manhours heretofore required in the assembling operation.

There is provided a mechanical seal 39 around the shaft 5 and above the impeller 36 and it is disposed in a position where the shaft 5 extends through the outer casing 25 and the volute casing 28 and it is supported by the volute casing 28.

The opening of the outer casing is closed by a cover member 43 which is installed on an annular mounting member 40 fixed to the outer casing 25 by means of a plurality of stud bolts on the member 40 and a plurality of nuts 40*a*. Between the cover mounting member 40 and the cover member 43, there is preferably disposed an annular packing 42. A sealing member 44 is preferably installed surrounding the joint portion between the outer casing 25 and the cover member 43. To complete the flow passage of the pump, a ridge plate 45 is disposed in the volute chamber so as to direct the liquid flow toward the discharge opening element 27 through a short conduit 46 which conducts the discharge port element 27 with the volute casing 28.

As briefly touched upon earlier, the motor section "A" is coupled to the pump section "B" by the studs 47 and the bolts 10. The studs 47 are fixed to the pump outer casing 25 by any suitable means such as welding. Due to the length of the studs 47, there is created a space 48 between the lower plate 9 and the top surface of the pump section "B". By the proper adjustment of the length of the studs 47, the position of the motor section "A" in the axial direction relative to the pump section "B" is determined so that the axial position of the impeller 36 is readily adjusted. Such adjustment is accomplished by either one of the processes noted below. That is:

(a) Properly selecting the length of studs 47;
(b) Trimming the length of the studs 47; and
(c) Inserting shims or washers.

Therefore, in assembling the sections "A" and "B" after deciding the length of the studs 47, it is only required to adjust the radial position of the cover plate 30 while maintaining proper gap "δ".

The mechanical seal 39 effectively prevents liquid from entering the space 48; however, should it fail in its function during the operation of the pump, liquid may leak into the space 48 thereby creating possibility of wetting the coil of the motor and the bearing 7. In order to protect such elements in the motor section from such possibility, a shielding member 49 is attached at the upper wall 25*a* of the pump outer casing 25 so that leaked liquid will not be directed toward the vent holes 9*a* and 4*c* due to the existence of the closed portion 49*a* but towards the vent holes 24 through the opening 49*b*.

Figure 2:
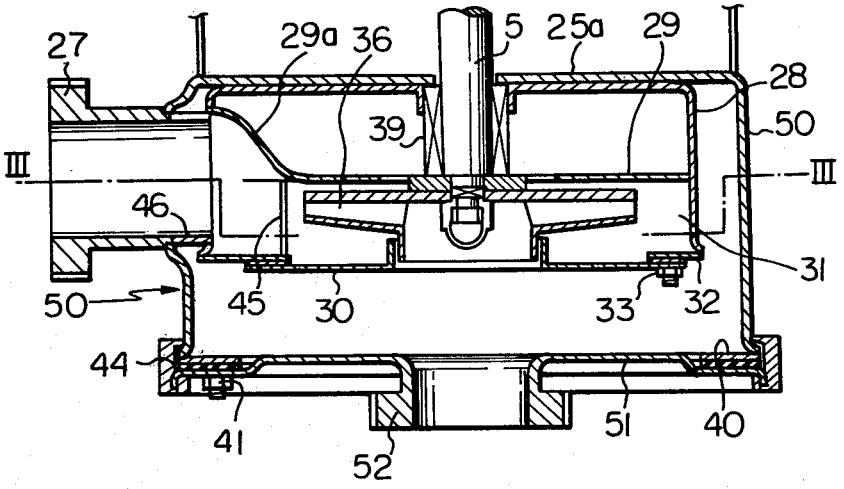
FIG. 2 shows a cross-sectional view of a pump section which is modified from that shown in FIG. 1.

In the preferred embodiment illustrated in FIG. 1, the intake and discharge or outlet port elements 26 and 27 are disposed diametrically opposite with respect to the pump outer casing, but the arrangement of the port elements is not limited to such aligned state. Referring to FIG. 2, there is illustrated a modified outer pump casing 50 wherein suction is effected in a direction perpendicular to the direction of flow of the liquid being discharged. The outer casing 50 is almost the same as the casing 25 except for the intake port element 26 and the cover member 43 in FIG. 1. The side wall of the pump casing 50 is closed except for the discharge port element 27 and, at the lower end opening of the casing 50, a cover member 51 is attached in a manner similar to that of the cover member 43 of FIG. 1. The cover member 51 is provided with an inlet port element 52 through which liquid is sucked into the volute chamber 31.

In the embodiments shown in FIGS. 1 and 2, the casings and covers are able to be formed out of sheet metal stock in contrast to the pumps of prior art wherein the casings have been customarily made by casting process.

For example, the outer pump casing 25 or 50 may be formed into a pan-type shape by a press. The thus formed pan-type element may be further processed by a press or roll-forming to provide an opening or openings in the side wall and/or flange at the lower end. The volute casing is generally complicated in construction since it is provided with a ridge adjacent the discharge port of the volute casing.

Figure 3:
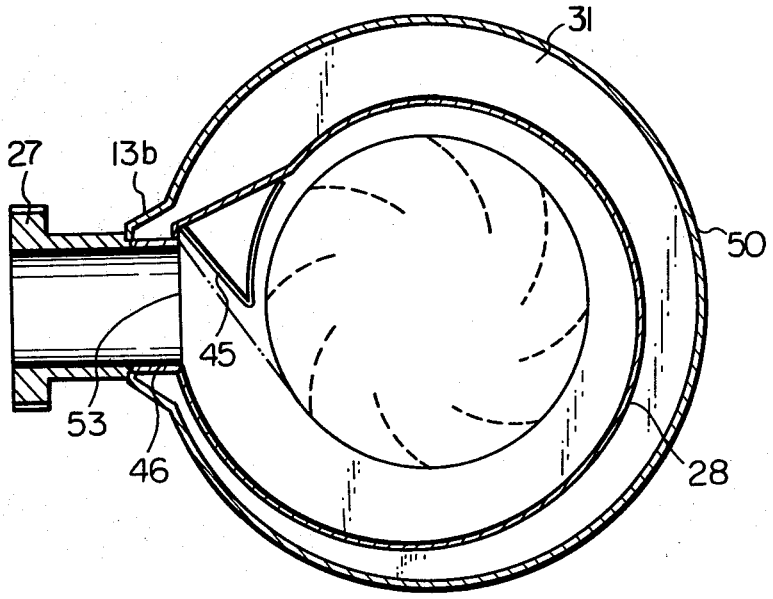
FIG. 3 is a further cross-sectional view taken along the line III—III in FIG. 2.

FIG. 3 is a sectional view of the pump casing and the volute casing taken along line III—III in FIG. 2. It is possible to form a ridge 45 from sheet metal stock by using ordinary press technique. The ridge 45 thus formed is welded to the volute casing 28 which is also preferably formed from sheet metal blank. An opening 53 is provided in the side wall of the volute casing and a short conduit 46 is welded thereto which is also coupled to the outlet port element 27 together with the pump outer casing by any suitable means such as welding. The cover plate 30, the cover members 43 and 51 are also readily formed from sheet metal blanks. As to the separator 29, it is also readily formed from a sheet metal blank by a press so that it is provided with a curved portion 29*a* which assists to smoothly connect the volute chamber outlet opening with the outlet port element 27. This separator is also welded to the inner wall of the volute casing 28. The volute casing 28 and the outer casing 25 or 50 may be joined by any suitable means, for example, preferably by spot-welding. By arranging and assembling the elements thus formed from sheet metal stock, the assembling operation is made relatively simple and easy and there is no need for the sealing member usually required between the volute casing and the upper wall thereof.

Figure 4:
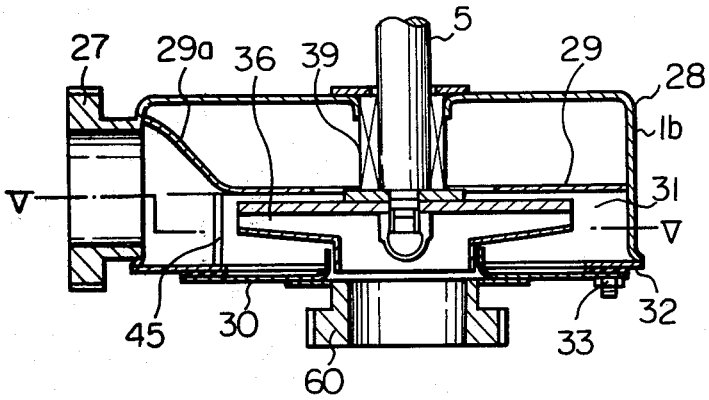
FIG. 4 is a further modified pump section similar to FIG. 2.
Figure 5:
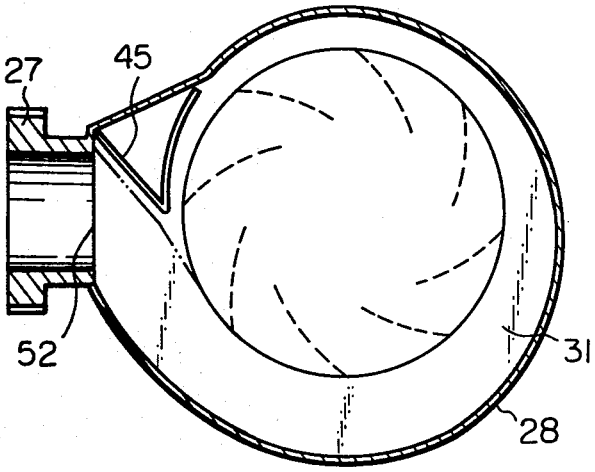
FIG. 5 is a cross-sectional view taken along the line V—V in FIG. 4.

A further simplified modification of the embodiment of FIGS. 2 and 3 is illustrated in FIGS. 4 and 5. In this embodiment, the outer pump casing in FIG. 1 or FIG. 2 is eliminated and an intake port element 60 is directly secured to the cover plate 30 so that liquid is directly sucked into the volute chamber 31 through the inlet port element 60.

While the invention has been explained referring to the embodiments, it should be understood that variations and modifications are available within the sprit and scope of the invention.

We claim:

1. A pump unit unitarily coupling a pump section and a motor section comprising:

a motor in the motor section;

a volute casing of a pan type in the pump section and provided with an outlet opening in the side wall thereof;

a separator separating a space in said casing;

a cover plate adapted to cover the open end of said volute casing to form a volute chamber within said casing in conjunction with said separator and provided with an opening serving as a suctioning opening of said volute chamber; and an impeller mounted on a shaft of said motor extending from said motor into said volute chamber, said cover plate being mounted to said volute casing in such a manner that it is adjustable in the radial direction with respect to the axis of said shaft.

2. A pump unit as claimed in claim 1 wherein the motor section and the pump section are coupled in the axial direction with a first space therebetween which is surrounded by a lower part of an outer casing of the motor, the wall of said lower part being provided with vent openings, the upper portion of the motor being surrounded by an upper part of the motor outer casing to provide a second space, the wall of said upper portion being provided with the vent openings and air ventilation passage being provided from the openings in the wall of said upper portion through the second space, the motor, the first space to said openings in the wall of the lower part of the motor outer casing.

3. A pump unit as claimed in claim 2 wherein the motor is sandwiched between an upper plate and a lower plate and it is secured to the motor section by a plurality of bolts extending through the upper and lower plates and the tip of each bolt is screwed into each of a plurality of studs having female threads and mounted on the top of the pump section, the upper and lower plates being provided with vent holes, respectively which form the part of said ventilation passage, the periphery of each of the vent holes in said upper plate being given an upwardly directed flange, the lower end of at least one of said vent openings in the wall of said upper part of the outer casing being positioned at the same level as or lower than the upper surface of the upper plate.

4. A pump unit as claimed in claim 3 wherein the motor is encased within an upper inner casing and a lower inner casing below said upper plate and above said lower plate respectively, the respective side walls of the inner casings being provided with vent openings so that air ventilation is also effected through said vent openings in the inner casings and the space between the inner casings and the motor outer casing.

5. A pump unit as claimed in claim 2 wherein a liquid shielding plate is disposed withih said first space over the portion of the upper surface of the pump section where the motor shaft extends into the pump section and a mechanical seal is installed, said shielding plate being formed so as to direct liquid leaked through said mechanical seal toward the vent openings in the wall of the lower part of said motor outer casing and not toward the vent holes in said lower plate.

6. A pump unit as claimed in claim 1 wherein said volute casing is provided with a plurality of stud bolts along the periphery of the opening and said cover plate is provided with a plurality of perforations which are arranged to receive said stud bolts therethrough, said plate being secured to the volute casing by screwing a plurality of nuts on said stud bolts, respectively, the respective sizes of said perforations being made larger than the diameter of said stud bolts.

7. A pump unit as claimed in claim 6 wherein said volute casing and said cover plate are made of sheet metal stock by press forming.

8. A pump unit as claimed in claim 7 wherein a ridge contained within said volute casing adjacent said outlet opening is formed from sheet metal stock by press forming and welded to the volute casing.

9. A pump unit as claimed in claim 1 further comprising a pump outer casing surrounding said volute casing, said outer casng being of a pan type and having an inlet port and an outlet port, the inlet port communicating with said suctioning opening through a space between the outer casing and the volute casing, and said outlet port communicating with said outlet opening of said volute casing.

10. A pump unit as claimed in claim 9 wherein said outlet and inlet ports are disposed diametrically opposite with respect to the pump outer casing.

11. A pump unit as claimed in claim 9 wherein said outlet port is provided in the side wall of said outer casing and said inlet port is provided in a bottom plate covering the end opening of said pan type outer casing.

12. A pump unit as claimed in claim 9 wherein said outer and volute casings and said cover plate are made of sheet metal stock by press forming, respectively.

13. A pump unit as claimed in claim 1 wherein the motor section and the pump section are coupled in the axial direction with a first space therebetween which is surrounded by a lower part of an outer casing of the motor, the wall of said lower part being provided with vent openings, the upper portion of the motor being surrounded by an upper part of the motor outer casing to provide a second space, the wall of said upper part being provided with vent openings and air ventilation passage being provided from the openings in the wall of said upper portion through the second space, the motor, the first space and to the openings in the wall of the lower part of the motor outer casing.

14. A pump unit as claimed in claim 13 wherein the motor is sandwiched between the upper plate and a lower plate and it is secured to the motor section by a plurality of bolts extending through the upper and lower plates and the tip of each bolt is screwed into each of the plurality of studs having female threads and mounted on the top of the pump section, the upper and lower plates being provided with vent holes, respectively which form the part of said ventilation passage, the periphery of each of the vent holes in said upper plate being given an upwardly directed flange, the lower end of at least one of said vent openings in the wall of said upper part of the outer casing being positioned at the same level as or lower than the upper surface of the upper plate.

15. A pump unit as claimed in claim 14 wherein a liquid shielding plate is disposed within said first space over the portion of the upper surface of the pump section where the motor shaft extends into the pump section and a mechanical seal is installed, said shielding plate being formed so as to direct liquid leaked through said mechanical seal toward the vent openings in the wall of the lower part of said motor outer casing and not toward the vent holes in said lower plate.

16. A pump unit as claimed in claim 14 wherein the motor is encased within an upper inner casing and a lower inner casing below said upper plate and above said lower plate, respectively, the respective side walls of the inner casings being provided with vent openings so that air ventilation is also effected through said vent openings in the inner casings and the space between the inner casings and the motor outer casing.

* * * * *